US005125726A

United States Patent [19]

Hahn et al.

[11] Patent Number: 5,125,726

[45] Date of Patent: Jun. 30, 1992

[54] DEVICE FOR THE PRESENTATION OF OBJECTS

[75] Inventors: Till H. Hahn; Klaus H. Fischer; Thomas O. Hahn, all of Frankfurt am Main, Fed. Rep. of Germany

[73] Assignee: Glasbau Hahn GmbH + Co. KG, Frankfurt am Main, Fed. Rep. of Germany

[21] Appl. No.: 7,529

[22] Filed: Jan. 28, 1987

[30] Foreign Application Priority Data

Jan. 29, 1986 [DE] Fed. Rep. of Germany ..... 3602539

[51] Int. Cl.[5] ..... A47B 97/00; A47F 3/00

[52] U.S. Cl. ..... 312/114; 312/204; 312/242

[58] Field of Search ..... 312/114, 118, 140, 304, 312/204, 242

[56] References Cited

U.S. PATENT DOCUMENTS

| | | | |
|---|---|---|---|
| 479,671 | 7/1892 | Smith | 312/118 |
| 694,987 | 3/1902 | Pollard | 312/114 |
| 717,910 | 1/1903 | Paulle | 312/114 |
| 2,023,260 | 12/1935 | Beers et al. | 312/114 |
| 2,241,182 | 5/1941 | Cayo | 312/114 |
| 3,181,913 | 5/1965 | Guido et al. | 312/114 |
| 3,341,267 | 9/1967 | Weitzman | 312/114 |
| 3,652,246 | 3/1972 | Michelotti et al. | 65/60.1 |
| 3,697,147 | 10/1972 | Schulte | 312/204 |
| 3,697,363 | 10/1972 | Martinez | 312/204 |
| 4,124,958 | 11/1978 | Chiche | 312/140 |
| 4,141,610 | 2/1979 | Ando | 312/304 |
| 4,155,608 | 5/1979 | Orlewicz | 312/242 |
| 4,255,001 | 3/1981 | Frishman | 312/114 |
| 4,304,447 | 12/1981 | Ellwood et al. | 312/204 |
| 4,612,217 | 9/1986 | Gordon | 65/60.1 |
| 4,702,534 | 10/1987 | Witt et al. | 312/114 |

FOREIGN PATENT DOCUMENTS

| | | | |
|---|---|---|---|
| 30565 | 7/1926 | France | 312/118 |
| 2504792 | 11/1982 | France | 312/114 |

*Primary Examiner*—Victor N. Sakran
*Attorney, Agent, or Firm*—Lane, Aitken & McCann

[57] ABSTRACT

Device for the presentation of objects, comprising at least one pane made of transparent material and having one or more sections made nontransparent, the inner surfaces of said sections being provided with fixing or attachment elements for joining the pane(s) with other parts of said device and/or for supporting accessory means. By means of said concealed fixing or attachment elements, the construction of which is therefore simple and moderate in price, a frameless joining of the pane(s) to form a device with continuous, uninterrupted panes is possible in which all the accessory means such as intermediate display platforms, illumination means, dust protection means, etc., which required heretofore complicated base portions and understructures and hood constructions, are directly attached on the nontransparent sections of the inner surfaces of the panes.

12 Claims, 5 Drawing Sheets 9
10
11
12

DEVICE FOR THE PRESENTATION OF OBJECTS

BACKGROUND OF THE INVENTION

The invention relates to a device for the presentation of objects comprising at least one pane made of transparent material and fixing or attachment elements for joining the pane with the other components of the device and/or for holding accessory means. The invention relates in particular to so-called display cases, display boxes and display cabinets as they are used, for example, in museums in large numbers and variety.

A conventional type of such display cases is a frame construction of wood, metal or plastic material and glass panes mounted in the frame of said construction. Even if those frames are made as small and dainty as possible with usually considerable technical and financial expenditure, grid-like impression impairing the exhibition cannot be avoided.

For this reason, many display cases or cabinets are provided with a base portion or understructure and with an all-glass hood (top portion) seated on said base portion. Such a hood may, as an upper termination, support a box for accommodating illumination devices (a lighthood) and for the attachment of an interior fitting of hanging glass shelves.

Even if in said cases, which are more or less a construction of glass-enclosing metal parts, frame-like structures between glass and metal parts are avoided, joints between glass and metal cannot be avoided.

In order to avoid the impression of a glass-enclosing frame construction, display cases have been developed having an understructure forming the bottom of said display case and to the outer surfaces of which understructure glass panes are fastened with screws. Said display cases can also be covered by a box which is supported by screw fittings extending through the glass. Besides the irritating optical impression due to the visible screw heads of the screw fittings, a drawback of such a display case construction is, above all, that accumulations of dirt between glass panes and the area of the screw become visible and cannot be avoided. When the dirt accumulated in form of dust or insects between the outer surfaces of the base portion and of the illumination box and the panes is to be removed, the panes have to be screwed off. This screwing-off, the cleaning and screwing-on again is time-consuming and expensive. Moreover, a removal glass pane or door to open the display case can be attached to said type of display box only by mounting the necessary large metal fittings visibly from outside on the panes.

SUMMARY OF THE INVENTION

The underlying object of the invention is to provide an improved device for the presentation of objects as referred to above to guarantee, to a very large extent, unobtrusivity of the fixing elements by simple technical means.

A decisive advantage of the device for the presentation of objects according to the invention, hereinafter called display case, is that all the fixing or attachment elements for joining the panes and for holding accessory means are invisible. It is therefore possible to use inexpensive and stable elements of any type and size desired which allow a safe and most advantageous joining and attachment.

As the fixing or attachment elements are provided directly on the inner surface of the panes and as, moreover, any type of elements may be used, the continuous panes, of which only some parts are nontransparent, can be joined with each other without the base portion and the frame constructions. In this way, the construction of a display case can be very moderate in price and the very best decorative effect can be achieved due to the uninterrupted and continuous, entirely flat panes without visible fixing elements. The objects can be exhibited in the visible spaces of the display case without the viewer being irritated by constructional means.

Moreover, there is an unlimited possibility of fixing accessory means. The sectioning of the panes into transparent and nontransparent sections is arbitrary so that a great variety of accessory means can be fixed at any level desired. As it is possible to join the panes immediately with each other, it suggests itself to utilize high-strength glass panes so that even heavy elements can all be attached to the panes, and lighthoods or base portions, for example, can at any rate be avoided. Light diffusers, illumination devices and upper covers are simply fixed to the panes.

Moreover, without box-shape parts being used, width and height of the display case can be chosen substantially arbitrarily. The angle under which the panes are joined with each other is also variable so that the display case can completely be adapted to the respective exhibition rooms without having to change the mechanical structure. In contrast to the base portions and lighthoods which have a reasonable price only in case of large series construction, the customer is not bound to such standardized boxes in case of the display case according to the invention. It is possible to build for the customer at low cost display cases according to his individual requirements which may, for instance be L-shaped or polygonal, if desired.

According to another aspect of the invention it is also possible to vary the shape of the display case subsequently and to combine, especially by simple means, several display cases by joining the panes according to one's wishes. Only additional intermediate display platforms, light diffusers and, possibly, dust-protection panes may be necessary which amount only to a minor percentage of the price for a display case. Such possibilities of variation are of great importance especially for museums where it is often necessary to adapt devices for the presentation of objects to those objects to be exhibited. The use of panel-like continuous panes as in cupboard units along a wall is also imaginable.

Moreover, the display case according to the invention, which can be manufactured without problems of high-strength glass, offers high safety protection without causing additional cost for security glass, as they must be paid for conventional constructions.

When it is desirable to use, for instance, bullet-proof glass for conventional showcase constructions complicated, expensive and large special channels and frames are necessary. The use of bullet-proof glass for a display case according to the invention is, however, possible without having to change the construction and without losing decorative effect.

Moreover, as many decorative effects as desired can be achieved, since interchangeable ornamental elements can be applied to the entirely smooth surfaces according to the purpose of presentation. Variable possibilities of configuration of such ornaments exist especially for the field of fairs. A firm's logo device or other inscriptions, illuminated from inside, can be provided, for example, in the nontransparent section of the display case.

As the display case according to the invention is composed of flat continuous surfaces, its cleaning is very easy and the danger that dust accumulates is minor.

It is a further object of the invention to provide a display case in which multilayer panes (laminated panes) are, for example, provided with a colored intermediate layer. Compared to applying a layer on the inner surface of a pane at a moderate price, the above type of pane has the advantage that there are no problems of fastening fixing or attachment elements on such a layer. Compared to a pane coated on the outer surface, the laminated glass pane, like the pane with a layer applied on the inner surface, has the advantage that the surface is overall reflective. Due to the possibility of making the laminated glass panes as solid as required, they offer an excellent protection against burglary.

It is a further object of the invention to develop a display case in which the nonvisible and therefore randomly formed and conditioned fixing or attachment elements may have such a configuration that a dismounting of the display case into plane sections for optimum stacking is possible. It is also possible to use appropriate fixing or attachment elements for self-supporting continuous glass constructions.

According to a further aspect of the invention removable panes can be fixed by invisible fixing or attachment elements and this way of fixing is without reservation. The possibility of providing the display case with decorative boards or walls for subdividing is manifold and variable.

A further advantage is achieved when metal sheets are used in the nontransparent sections. In this case the fastening of fixing or attachment elements is particularly easy.

In a further development of the invention the installation of curved panes, which has been very expensive for the conventional display cases with base portions, does not cause additional cost for the display case according to the invention without a base portion.

BRIEF DESCRIPTION OF THE DRAWINGS

The invention will be described hereinafter in more detail by the FIGS. of the drawing wherein.

DESCRIPTION OF THE PREFERRED EMBODIMENTS

EXAMPLE 1

Figure 1:
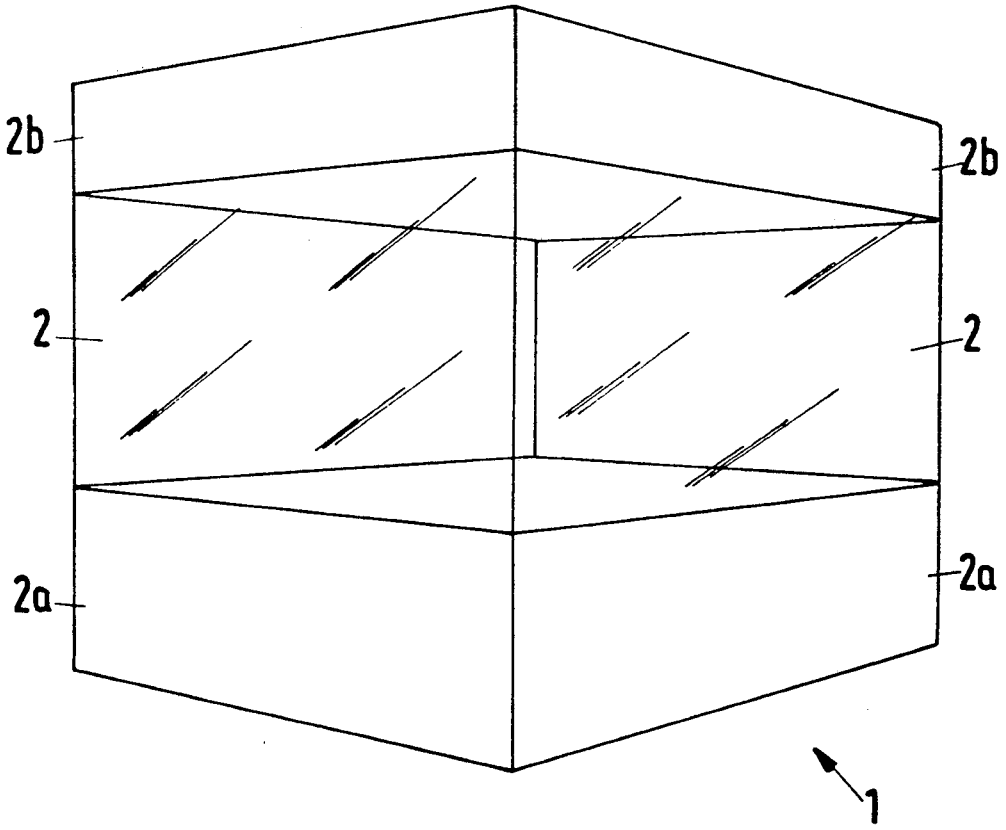
FIG. 1 is a perspective view of the first embodiment of the device according to the invention, FIG. 2 a longitudinal sectional view of the device as shown in FIG. 1, FIG. 3 a cross-sectional view of another embodiment of the device according to the invention, FIG. 4 a longitudinal sectional view of a table-shaped display case having the features according to the invention, FIG. 5 a perspective view of the display case of FIG. 4, and FIG. 6 a view of another embodiment of the device according to the invention.

FIG. 1 is a perspective view of a first embodiment of the device according to the invention for the presentation of objects and of the display case according to the invention, respectively. Said display case comprises several panes 2, which are preferably made of glass; break-resistant panes of plastics, for instance, are not excluded. The panes have a lower nontransparent section 2*a* and a corresponding upper nontransparent section 2*b*. The nontransparent sections of the transparent panes can be obtained by coating or the outer surface of the pane appropriate, preferably colored layers. Such a coating may, for instance, be a coat of paint. For this purpose, the outer surface of the pane is painted with conventional paints sufficiently known from glass painting. Said lacquers well adhering to glass may, however, not have a high mechanic solidity so that they can soon be scratched in use. When this layer of paint is applied on the inner surface of the pane in order to avoid the above drawback, it may be that said layer of paint renders difficult a nonpositive connection between the pane and said attachment or fixing elements. More solid surface coatings not having said drawback are, for example, glazings which can be applied.

The use of laminated glass panes allows in an especially advantageous way to make nontransparent sections. Laminated security glass comprising two panes especially suggests itself for this purpose. The sections 2*a*, 2*b* of a simple glass pane which is to be made nontransparent are coated with paint. Screen-printings on glass are well known, and these very paints and corresponding application methods are particularly suited for this purpose. When the tints are light, several layers have to be applied in order to achieve an effectively opaque layer of paint, as it is especially necessary in the section 2*b* when said upper portions of the display case are used as lighthood. In order to avoid that the light sources emit light outward, a layer of silver paint can be applied inside after some layers of lacquer have been coated whereby complete nontransparency is warranted also in case of light paints. This pane partly coated with colored paint on one surface is further processed by means of a second pane and a bonding layer to be a composite glass pane after the lacquers have dried so that the layer of paint is embedded entirely safe between the glass panes. The production of laminated glass according to the known production method of PPG is well known and so is production with a sealing compound according to the Franz-Xaver-Bayer system. The two surfaces of laminated glass pane produced in this way exhibits on its both surfaces entirely untreated flat and smooth glass. This surface is adapted on one hand to offer the viewer a flat reflective and mechanically high resistent surface and, on the other hand, to have an inner surface showing into the display case which is excellently suited for gluing the fixing or attachment elements.

The fixing or attachment elements are, for instance, rectangular steel tubes which are glued on horizontally in the section coated with paint. The adhesive to be applied is not visible from outside, since it is provided behind the layer of paint. Hence, the optical effect of the adhesive layer does not have to be appreciated. For gluing on or bonding steel channels adhesives on silicone basis are suited because during a test period of more than 20 years they have meanwhile proved to establish a fatigue-proof adhesion with glass. The conventional single-component silicone materials, however, require air humidity for solidification so that for the large surfaces which are to be glued here materials are suited which can polymerize without being affected from outside. Wacker-Chemie produces a two-component product which in the best possible way meets the requirements of a primer to be applied on the glass and on the steel.

Moreover, composite glass panes produced in this way have the advantage of being a good protection against accident and burglary.

Silicate glass as it is being used here nowadays is produced worldwide according to the float glass process. Slightest temperature differences in the cooling phase of the glass cause a minor curvature of the panes. A careful production of the composite glass described above guarantees—due to the sandwich-like joining of two panes—plane surface of the panes and as soon as the material used for bonding has solidified the plane character is also retained. These entirely pane surfaces are especially suited for manufacturing display cases having large area panes, since the flat surface causes least possible distortions and does not cause unsteady reflections, thus allowing a substantially unhindered view into the display case.

Figure 2:
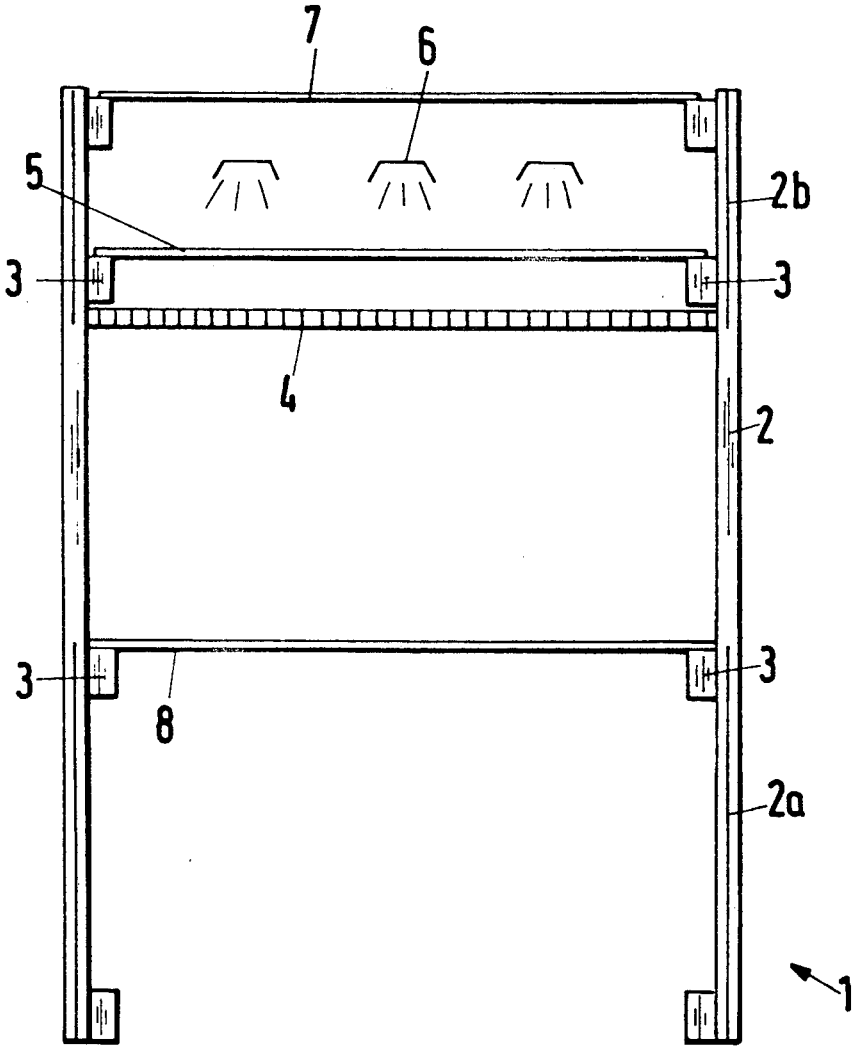

FIG. 2 is a longitudinal sectional view of the display case as shown in FIG. 1. This sectional view illustrates how easy and unproblematic it is to attach most different accessory means in the display case by fixing or attachment elements 3.

By means of said attachment or fixing elements 3 a simple device will be developed to which the bottom shelf 8 of the display case, light diffuser 4, dust protection glass pane 5, light objects 6, cover 7 and, if necessary, some more means can easily be attached. For this purpose, a rectangular steel track is glued in this embodiment horizontally to the pane. The gluing or bonding method has been described before. The laminated glass pane used here has a lower and an upper nontransparent section. To each individual nontransparent section a horizontally extending rectangular track is glued in the vicinity of its upper and lower edges. Said fixing element is provided with a plurality of holes, slots and break outs which have been punched out before so that there are various possibilities to insert and mount display case elements. Due to the large adhesive area said fixing or attachment elements are especially tight and highly loadable, and hence the permanent solid connection with glass is not endangered. It is easy to fasten the fixing or attachment elements to the glass in exactly the right position by a slip, as it is not absolutely necessary to provide the whole surface with the adhesive but to leave e.g. one or two sections free of adhesive at which a two-sided self-adhesive tape is provided, the gluing of these fixing or attachment elements is possible in the shortest possible time intervals. The tape holds the attachment elements in the desired position until the adhesive is polymerized. This very suitable mounting method for the fixing or attachment elements is, of course, possible especially because the adhesive surface, as mentioned above, is concealed from outside due to the pane section made nontransparent. As the hardware to be mounted later on into the display case is fixed by means of longitudinal slots and screws provided in said attachment or fixing elements, inaccuracies occurring when the attachment or fixing elements are glued on can easily be compensated.

The panes to be erected are underlain and adjusted at the lowermost fixing or attachment element. As floors are usually not entirely flat, as, however, the display case is to be suitably plumbed and angled, it is necessary to underlay the bottom with differently high wedges or support chocks. Said wedges or support chocks are placed under the lowermost fixing or attachment element. Said attachment element may also be provided with a simple adjusting screw for adjusting the display case. If such an adjusting screw is not provided for saving expenses but yet necessary because of the unfavorable constructional situation, a little adjusting foot or, in case of small display cases, also a roller can be screwed to said fixing or attachment element.

In case special devices are desired for a display case, such as a small air conditioner, it may be put and screwed on in the lower section to the lower fixing or attachment elements. In case it is desirable to make the bottom shelf 8 of the display case to be described below transparent or translucent, for instance a milkglass pane and a lighting can be provided in the lower portion of the display case which lights the object exhibited from below 20, through the milk-glass pane. It is suitable to support this lighting also at the lower fixing or attachment elements. It is also possible to furnish the lower portion of the display case with a third—not shown—additional attachment or fixing element in order to have more possibilities of fixing means when the display case is to serve another purpose. It is imaginable that drawers supportable by said fixing elements become necessary for a drying agent to protect the objects exhibited when the display case is used for a different purpose. Such a simple reorganisation or different utilisation of display cases is impossible with the known framed constructions of display cases the less so since the panes in these constructions hardly have loading or carrying capacitance. It is, of course, possible to glue, if necessary, an additional fixing element on the mounted display case. The rectangular tracks, some adhesive and the mounting tape will do and allow a resetting of the display case. Besides steel also other materials can be used for the fixing and attachment elements, and it is not absolutely necessary that the tracks have a rectangular form.

The objects to be exhibited are placed on the bottom shelf 8 of the display case which is usually made of plywood of a thickness of 19 mm which is covered with decorative material on one side. The solidity of the shelf depends on the objects to be exhibited and on the size of the display case, i.e. on the span width of the bottom shelf. If the bottom shelf proves not to be sufficiently solid, it can be reinforced by supporting it and gluing it with rectangular ledges. U-shaped or T-shaped channel extending along the width and the depth of the display case may be screwed with the attachment or fixing elements 3 in order to support the bottom shelf 8 of the display case in many points. If a large number of one size of a display case is produced, trapezoidally edged metal sheet is especially suitable to support the plywood bottom shelf. In case a predetermined position of said bottom shelf is loaded by a heavy object, a corresponding channel can be provided underneath the bottom shelf from one to another attachment element thus supporting the bottom shelf at this very position. When the display case is reset or charged over and an additional support is required at a different place, said supporting channel can easily be released from the fixing or attachment elements and screwed at a different place. If posts are required in the display case which have horizontally extending support arms like a Christmas tree to carry additional glass panels or other platforms for objects to be displayed, said posts can extend through boreholes in the bottom shelf 8 into the lower portion of the display case between the fixing and attachment elements 3 an appropriate support should be screwed to hold said posts and to secure them against tilting. This aspect also shows that fixing or attachment elements provided at the solid outer glass body which is stable in itself permit individual utilisation which is not known from other constructions. Conventional display cases usually have 4 legs and devices to protect them against theft must be provided, because it is easy to reach the objects inside the display case from below through the bottom shelf. In order to avoid a plywood bottom to be screwed on in conventional constructions a complicated mechanism is often provided which secures the bottom shelf which is to be taken out for different purposes against burglary when the door of the display case is closed. The bottom shelf 8 in the present case can loosely be supported in the display case, since the glass which is preferably burglar-proof extends down to the bottom. Without a border channel or similar means the covered bottom shelf extends directly and jointlessly from glass surface to glass surface which is in favor of the optical impression.

The light diffuser 4 is used to terminate the interior of the display case optically upwards. Light diffusers LOUVERLUX P 13 silver made of polysterene offer very good light diffusing effects. A plurality of these light diffusers produced only with relatively small dimensions have to be combined if need be. For this purpose, auxiliary means in the form of T-shaped or U-shaped channels can be provided above said diffuser to extend from one fixing or attachment element 3 to the other one 3 at which the light diffusers can be hung up by means of small decent hooks.

An otherwise hardly avoidable small frame to support the diffuser is therefore unnecessary and the diffuser extends continuously and without any enclosing frame from one surface of the glass pane to the other one. Besides the comparatively expensive LOUVERLUX diffuser other light diffusers used to screen and shade off fluorescent lights can be installed. An optically most pleasant effect can be achieved by providing the light diffuser somewhat higher than the lower edge of the layer of paint 2*b*. This provides an additional shadow and a still better concealment of the light source.

The space above the dust protection glass panel 5 accommodating the illumination means 6 is ventilated for heat dissipation, and the dust protection glass panel 5 is to permit the entrance of light into the interior of the display case and to additionally protect the interior against heating by the light means. A construction with thin ornamental glass used additionally to diffuse light is advantageous. In order to avoid burglary the dust protection glass panel 5 can also be made of solid laminated security glass.

The light means comprises fluorescent tubes arranged side by side. Additional point light sources may be mounted to illuminate individual objects. The heat generated by reactors and starters of the luminescent tubes and by the bulbs of the point light sources is carried away through ventilation slots provided in the cover plate 7.

The cover plate 7 is the upper external termination of the display case and can be opened or removed to have an access to the illumination means. The ventilation slots in the cover plate are additionally screened such that light from the illumination means 6 does not fall outwards through said cover plate. In case the dust protection glass panel 5 is not provided to prevent burglary, said cove plate 7 can be adapted to be locked.

Depending on the purpose of use of the display case illustrated in FIGS. 1 and 2 ¾ additional round rods may be set at the corners of the glass panes. Said round rods may be a drawn hollow aluminum channel which may be differently eloxed depending or the client's desire. Paint coatings are also possible. The current required to illuminate a display case is often supplied through channels in the bottom and reaches the display case from below. In order that the cable may reach the light means in a concealed way the cable is guided upwards through an inwardly hollow ¾ rod. Besides the possibility of an edge joint of glass panes prepared with jumper joint or with miter grinding it is also possible to provide a channel with rectangular or triangular cross sections in the corner. Such a channel is preferably hollow inside permitting the above-described rising mains to extend.

EXAMPLE 2

Figure 3:
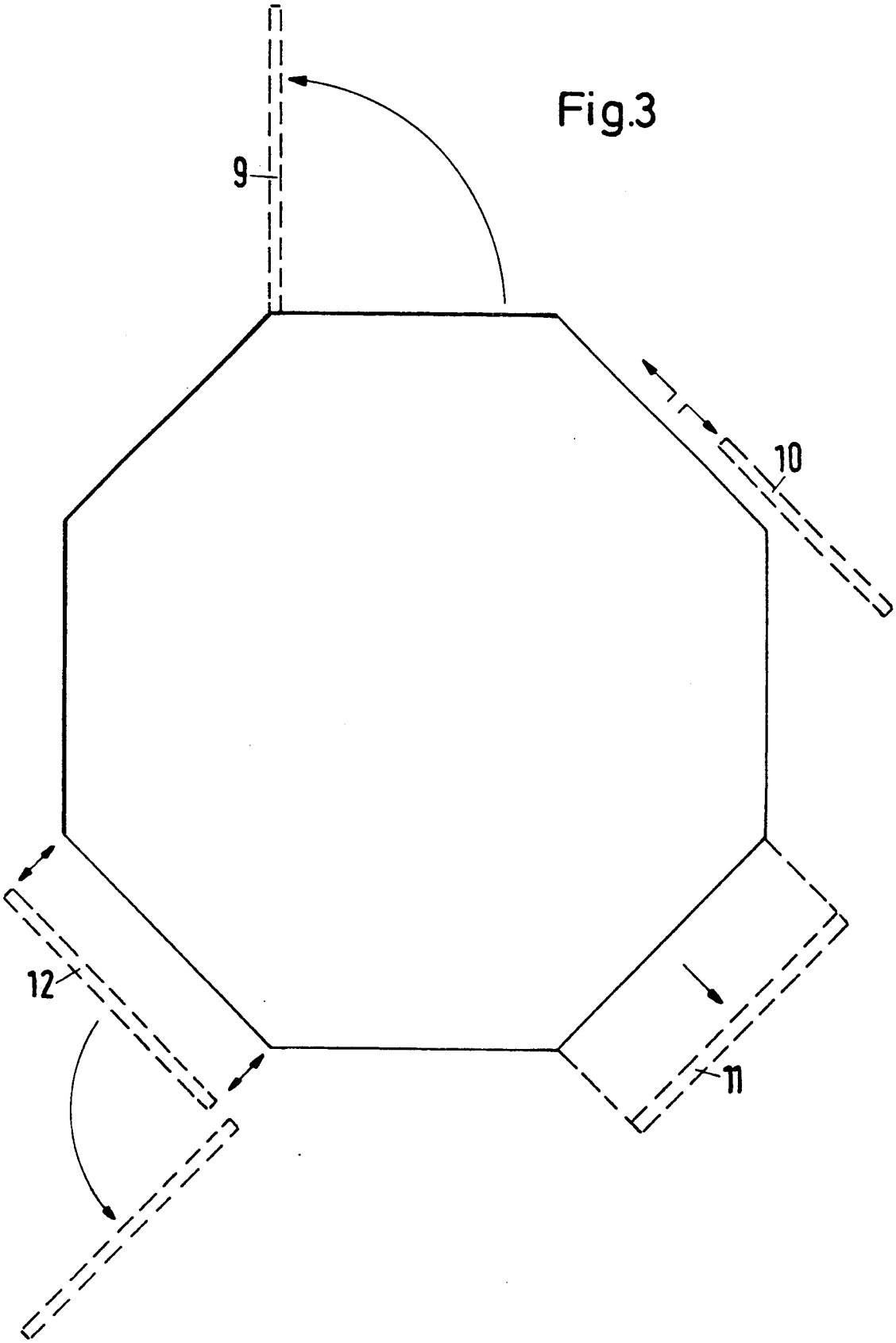

FIG. 3 illustrates the cross sectional view of an octagonal display case showing different possibilities of mounting removable glass panes. As the panes are adapted to be joined without base portion or understructure, such an octogonal embodiment does not make any constructional difficulties. Where the panes are joined at right angles or obtuse angles the fixing or attachment elements 3 are interconnected by means of screwed-on corner angles whereby the display case is made solid. A display case which is, for example, rectangular is in a condition to stand independently with three fixed panes, and a door means may alternatively be a wing door 9, a three-way sliding door 10, a removable (set-in) pane 11 or a three-way wing door 12. The stationary glass panels may be interconnected in the area of the door also in the lower or upper portion of the display case by rectangular tracks remaining stationary when the door is opened. Hinges known from furniture are screwed to the fixing or attachment elements of the door at the attachment or fixing elements of the stationary glass panels, for example for the wing doors 9 and 12, which is the simplest solution. A display case with an exactly rectangular cross section can, however, not be opened in this way by a side glass panel because the heavy glass panel opened by 90° would cause the display case to tilt over. In such a case an opening as illustrated below 11 and 10 will be used. The door 10 may be a monorail door or a duorail door (cf. also German Patent 1 554 233). This sliding-door system is most convenient. It is also possible to use the removable (or set-in) glass panel 11 which is moderate in price. The supporting means of said glass panel is provided with hooks to be hung into lugs provided inside the display case at the supporting means. This way of suspension is well known from the independent upper cupboards of kitchen cupboards.

If the unusual octagonal display case illustrated in FIG. 3 is no longer used, the elements can be rearranged without great expenditure, since understructures and lighthood elements are not required.

EXAMPLE 3

Figure 4:
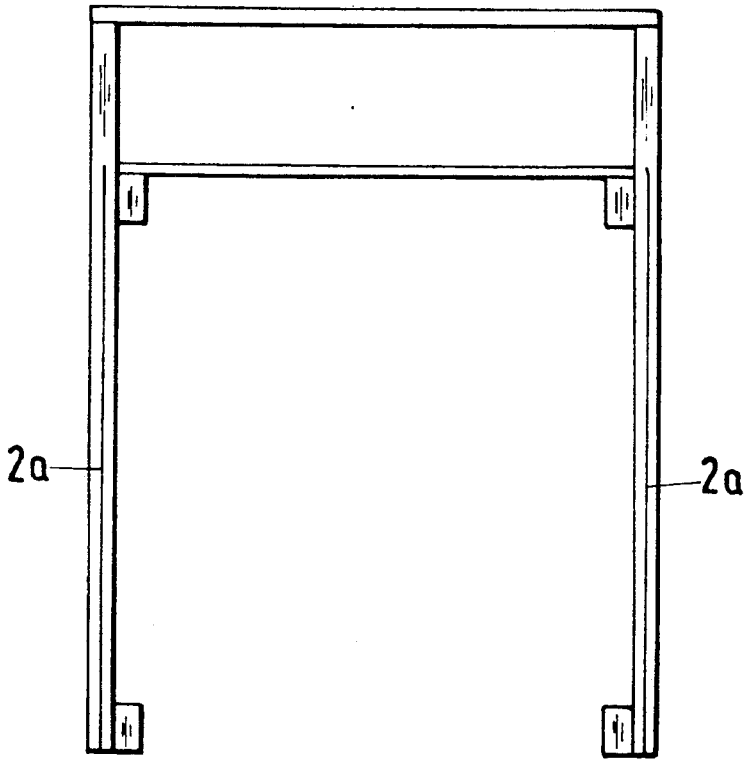
Figure 5:
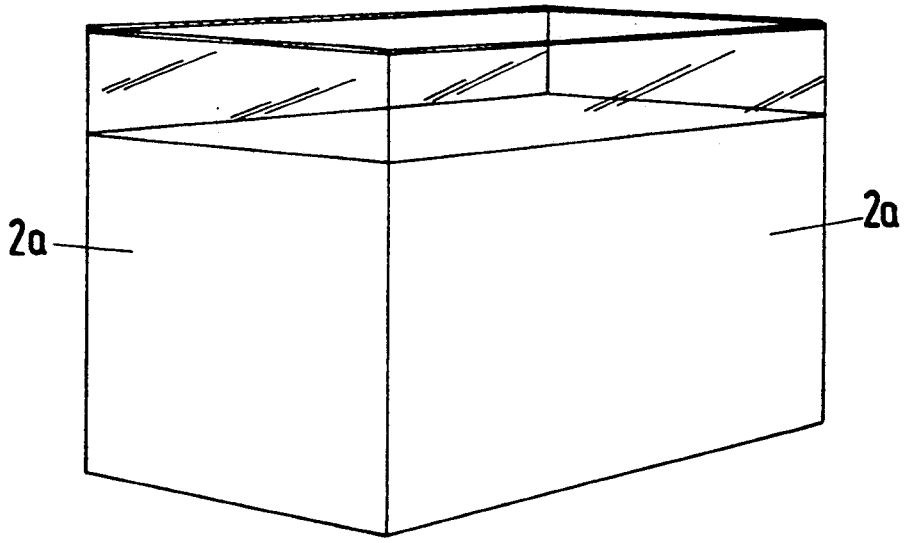

FIG. 4 illustrates the cross sectional view of a table display case as they are often used for museums and all types of shops. The nontransparent sections 2*a* are provided only in the lower section of the display case down to the bottom, as it is also shown in FIG. 5, which is a perspective view of the display case according to FIG. 4. The otherwise complicated and large base portions and understructures of the conventional table display cases which can mostly not be used again is not required, since the display case illustrated is an all-glass construction. Besides the fact that said all-glass construction is much more moderate in price and very variable, it has the decisive advantage of a very pleasant appearance particularly because there are nc unpleasant steps and interruptions between glass surface and metal surface, but the reflective surfaces are continuous.

In case of such a table display case in which a light source is to be installed it is possible to make one of the panes entirely nontransparent and to make the cover pane also nontransparent in the area where it abuts the nontransparent pane. In this way a concealed corner is provided in which nonvisible light sources can be accommodated.

EXAMPLE 4

Figure 6:
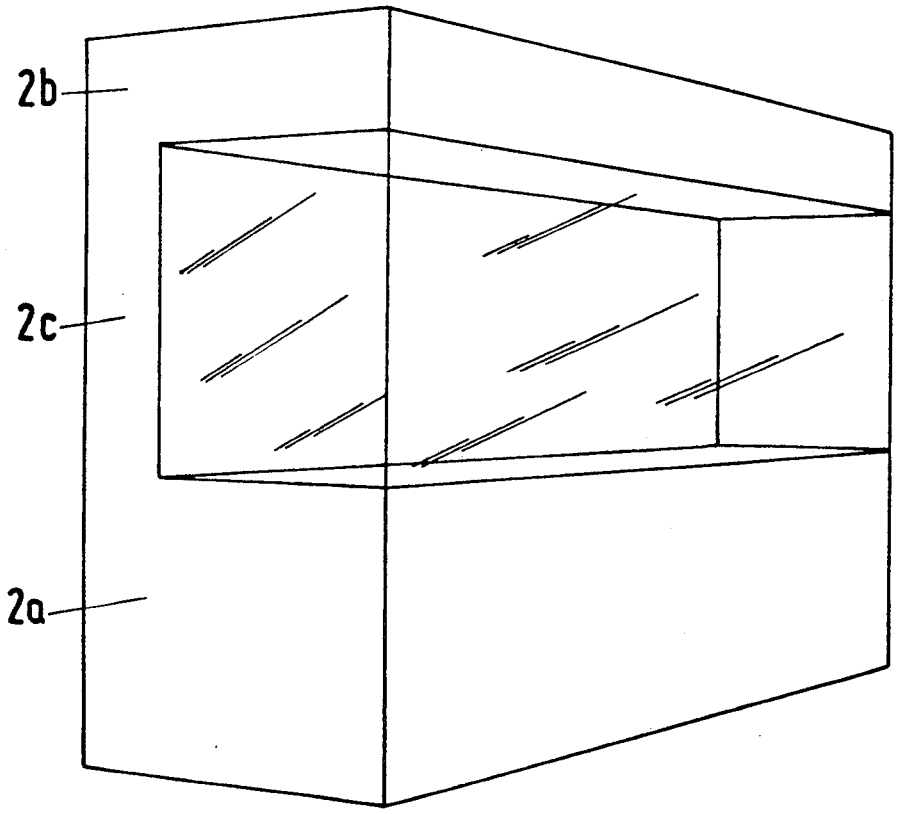

FIG. 6 illustrates a display case especially adapted to be placed against a wall or in a niche. The rear wall of said display case is overall nontransparent, preferably colored. Moreover, the lateral panes include in addition to the nontransparent sections 2*a* and 2*b* a nontransparent section 2*c* connecting said other sections 2*a* and 2*b*. The throughout-dyed rear wall may a glass pane or made of any other suitable material and can be used for different purposes of presentation. The illumination of the display case may be in the way as shown in FIG. 2, however, this display case and many other display cases may be illuminated by emitting illuminating light from an appropriate ceiling lamp into the display case. The ceiling lamp may be a concentrated light source whose light is dispersed and sent as diffuse light into the display case. It is also possible to scatter the light of the external light source through a light scattering louver in the upper nontransparent section of the display case, which is not covered, which louver is covered by a dust-protective plate. When the existing light is sufficient it may be used to illuminate the display case so that an additional light source for the display case is not required.

The above-described embodiments show only a few possibilities which can be realized by the features according to the invention., a large number of additional embodiments are imaginable, such as round display cases or those with smoothed-off corners or different fixing or attachment elements and illumination devices without having to deviate from the inventive idea or to go beyond the protective scope of the invention. Even if the display case according to the invention is, in principle, a self-supporting all-glass construction, it is not excluded to put said all-glass construction on an appropriate understructure in order to protect the glass and especially in case of uneven bottom surfaces.

What is claimed is:

1. In a display case for presentation of objects comprising a plurality of panels and means fixing said panels together to form an enclosure defining an interior, with at least one of said panels comprising a pane having a transparent section, the improvement wherein all of said panels including said pane have nontransparent sections, said means fixing said panels to hold said panels only on said nontransparent sections on sides of said panels facing said interior of said enclosure such that said panels are fixed together to a self-supporting construction without any frame members.

2. The device according to claim 1, characterized in that the pane is a glass pane.

3. The device according to claim 2, characterized in that the glass pane is a multilayer pane and that the nontransparent sections are formed by a colored intermediate layer.

4. The device according to claim 2 comprising a plurality of glass panes, characterized in that each of said panes have a section made nontransparent and that the fixing means is such that the glass panes can be jointed to form a self-supporting all-glass construction.

5. The device according to claim 1, characterized in that the inner surface of the nontransparent section of the pane is coated.

6. The device according to claim 1, characterized in that the outer surface of the nontransparent section of the pane is coated.

7. The device according to claim 1, comprising a plurality of panes made of transparent material assembled into an enclosure, characterized in that each of the panes has a section made nontransparent and that metal sheets are provided within said sections on the inner surface of the panes, the inner surface of said metal sheets being provided with attachment elements.

8. The device according to claim 1, characterized in that the pane is provided with nontransparent sections in its lower and in its upper portions.

9. The device according to claim 1, characterized in that said fixing means comprises attachment elements supporting horizontal subdividing means of said device.

10. The device according to claim 1, comprising a plurality of panes of transparent material, characterized in that the panes of the dismounted device together with the fixing means are plate-shaped structures.

11. The device according to claim 1, characterized in that the device includes a second pane that is movable.

12. The device according to claim 1, characterized in that the device includes a pane made of transparent material that is curved.

* * * * *